US009662851B2

(12) United States Patent
Mathieu et al.

(10) Patent No.: US 9,662,851 B2
(45) Date of Patent: May 30, 2017

(54) ONE-PIECE BLANK, DISPLAY CASE, AND METHOD AND DEVICE FOR PRODUCING SUCH A CASE FROM SAID BLANK

(71) Applicant: OTOR, Paris (FR)

(72) Inventors: Gerard Mathieu, Cergy (FR); Thierry Colas, Quetigny (FR); Sebastien Jacomelli, Nanton (FR)

(73) Assignee: OTOR, S.A., Paris (FR)

( * ) Notice: Subject to any disclaimer, the term of this patent is extended or adjusted under 35 U.S.C. 154(b) by 667 days.

(21) Appl. No.: 13/752,627

(22) Filed: Jan. 29, 2013

(65) Prior Publication Data

US 2013/0137563 A1 May 30, 2013

Related U.S. Application Data

(62) Division of application No. 12/296,497, filed as application No. PCT/FR2007/000607 on Apr. 11, 2007, now Pat. No. 8,430,296.

(30) Foreign Application Priority Data

Apr. 12, 2006 (FR) ..... 0603236

(51) Int. Cl.
*B31B 1/26* (2006.01)
*B65D 5/68* (2006.01)

(52) U.S. Cl.
CPC ..... *B31B 1/26* (2013.01); *B65D 5/68* (2013.01); *B31B 2201/2604* (2013.01);
(Continued)

(58) Field of Classification Search
USPC ..... 493/102, 79, 80, 69
See application file for complete search history.

(56) References Cited

U.S. PATENT DOCUMENTS 283,209 A 8/1883 Colburn
2,022,305 A * 11/1935 Wellman ..... 493/59
(Continued)

FOREIGN PATENT DOCUMENTS

DE 2843506 A1 4/1980
DE 29513265 U1 10/1995
(Continued)

OTHER PUBLICATIONS

EPO machine translation of DE2843506, retrieved Jul. 10, 2015, 16 pages.*
(Continued)

*Primary Examiner* — Hemant M Desai
*Assistant Examiner* — Mobeen Ahmed
(74) *Attorney, Agent, or Firm* — Banner & Witcoff, Ltd.

(57) ABSTRACT

A method for the production of a packing case from a one-piece blank, comprising a band of at least four main panels connected together by parallel fold lines, and furnished with two series of flaps situated on either side, for respectively forming at least partly the bottom and the top of the case. The band comprises a precut transverse line over the main panels to divide the blank into a first and a second half-blank. The half-blanks are separated, the first is placed in a transfer channel, the second is held in a plane higher than that of the transfer channel, the first is transferred to a mandrel while applying adhesive, and the first is wrapped around the mandrel. The transfer channel allows the second to be lowered to the channel, transferred to the mandrel, and wrapped around the first half-blank before folding the flaps.

3 Claims, 5 Drawing Sheets

(52) U.S. Cl.
CPC . *B31B 2217/0038* (2013.01); *B31B 2217/066* (2013.01); *B31B 2217/082* (2013.01); *B65D 2301/10* (2013.01)

(56) References Cited

U.S. PATENT DOCUMENTS

| | | | | |
|---|---|---|---|---|
| 2,251,283 | A | | 8/1941 | Johnson |
| 2,658,664 | A | | 11/1953 | Hennessey |
| 3,069,980 | A | * | 12/1962 | Kendall et al. ..... 493/102 |
| 4,208,955 | A | * | 6/1980 | Doll et al. ..... 493/102 |
| 4,222,312 | A | * | 9/1980 | Wohlfarter ..... 493/96 |
| 4,396,115 | A | * | 8/1983 | Watson ..... 229/102.5 |
| 4,474,324 | A | | 10/1984 | Forbes, Jr. |
| 5,016,753 | A | | 5/1991 | Henderson |
| 5,381,948 | A | * | 1/1995 | Coalier et al. ..... 229/109 |
| 5,505,368 | A | | 4/1996 | Kanter et al. |
| 5,505,369 | A | * | 4/1996 | Taliaferro ..... 229/122.32 |
| 5,507,430 | A | | 4/1996 | Imhoff |
| 5,715,993 | A | | 2/1998 | Pareike |
| 5,779,129 | A | | 7/1998 | Herbst et al. |
| 6,557,708 | B2 | * | 5/2003 | Polacco ..... 206/774 |
| 6,752,311 | B2 | | 6/2004 | Tulkoff |
| 2004/0084350 | A1 | | 5/2004 | Kim |
| 2004/0261368 | A1 | * | 12/2004 | Focke et al. ..... 53/449 |
| 2007/0111715 | A1 | | 5/2007 | Howard |
| 2007/0232472 | A1 | * | 10/2007 | Ludovissie et al. ..... 493/69 |
| 2011/0049226 | A1 | * | 3/2011 | Moreau et al. ..... 229/112 |

FOREIGN PATENT DOCUMENTS

| | | | |
|---|---|---|---|
| DE | 20202418 | U1 | 7/2007 |
| EP | 0334707 | A1 | 9/1989 |
| FR | 2875218 | A | 3/2006 |

OTHER PUBLICATIONS

International Search Report, in PCT/FR2007/000607, completed Oct. 4, 2007, mailed Oct. 12, 2007.

* cited by examiner

FIG.8
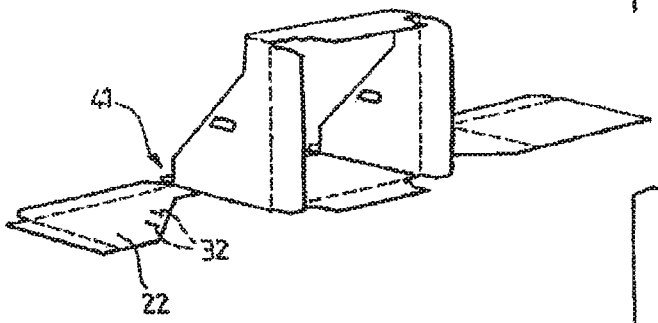
FIG.9
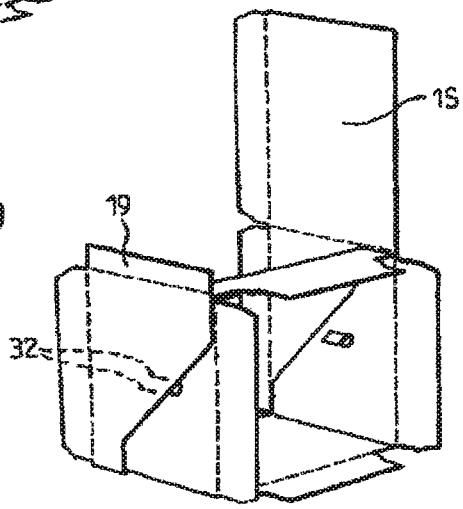
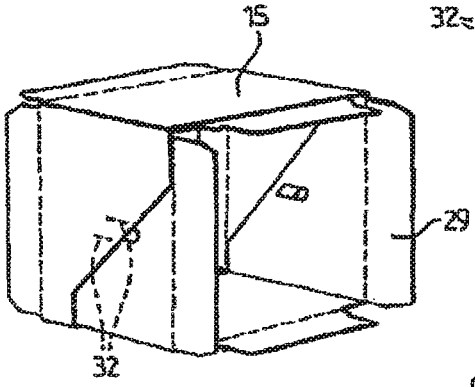
FIG.10
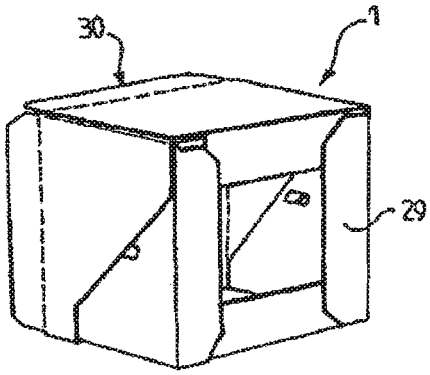
FIG.11

ONE-PIECE BLANK, DISPLAY CASE, AND METHOD AND DEVICE FOR PRODUCING SUCH A CASE FROM SAID BLANK

The present invention relates to a one-piece blank made of corrugated cardboard for the production of a display case comprising a band comprising at least four main rectangular panels, connected together in pairs by parallel fold lines, and furnished with two series of flaps situated on either side, suitable for forming respectively at least partially the bottom and the top of the case.

It also relates to a case obtained with such a blank and the method and device for producing the case from this one-piece blank.

The present invention finds a particularly important, although not exclusive, application in the field of packaging for rigid or semi-rigid products of the flexible cardboard sheath, packet or sachet type, making it possible to easily display the products inside or outside their transport packaging immediately, cleanly and attractively, notably on the shelves of the departments of superstores.

Already known (EP 0 637 548) are packing cases allowing the separation of the top portion of the case relative to the bottom portion and then allowing use sometimes as a transport case and sometimes after tearing off the cover as a display case.

Such a case is formed from two blanks and has the disadvantage of not being easy to form automatically. It also requires two supply magazines of different blanks during the mounting or assembly of the case.

Also known are productions of display cases with flaps produced from a single cardboard blank. The latter is furnished with precut side faces or panels which, after said panels have been torn off, make it possible to obtain a display case effect for the portion retaining the products. Such a type of one-blank packaging however has a weakened structure because of the very existence of a precut line of weak resistance to bulling and furthermore does not allow a quality of display that is sufficient and reliable because of the tearing off of the precut portion which may be done unevenly.

The object of the present invention is to provide a blank, a case, a method and a device providing a better solution than those previously known to the requirements of the practice, notably in that it allows automatic mounting at a high rate (more than 20 cases per minute), while having great robustness and a virtually zero rate of malformed cases, the cases thus obtained by the invention furthermore being easily palletized and allowing, after opening, an excellent quality of display, repetitively.

With the invention, it therefore becomes possible to produce a very economic package that can be converted into an on-the-shelf display case, simply by separating blobs of adhesive, without requiring the tearing off of precut zones during installation, and while using only one blank.

Using only one blank while avoiding the disadvantages of the prior art associated with the weakening of the precut lines has many advantages.

Therefore, only one cutting tool needs to be provided, there is only one cardboard reference to manage, and an optimized blank palletization is obtained, and all this with a single magazine to be loaded in the formation machine.

With this objective, the present invention notably proposes a one-piece blank made of corrugated cardboard for the production of a display case comprising a band comprising at least four main rectangular panels, connected together in pairs by parallel fold lines, and furnished with two series of flaps situated on either side, suitable for forming respectively at least partially the bottom and the top of the case, characterized in that the band comprises a precut transverse line making it possible to divide the blank into two half-blanks, said transverse line determining on either side and for each parallel fold line two separate portions of fold line offset relative to one another in order to make it possible to at least partly compensate for the thicknesses of cardboard when the second half-blank is wrapped over the first half-blank around a mandrel.

"Precut transverse line" means a line of attachment between the two half-blanks which may be carried out via several points that can be attached together and are therefore easy to pull apart from one another in the plane and/or perpendicularly to the plane of the blank.

In advantageous embodiments, use is also made of one and/or the other of the following arrangements:

- the band of panels comprises a first central panel connected on either side to a second panel and to a third panel by two of the parallel fold lines, called first fold lines, the portions of first fold lines of the first half-blank being offset toward the inside of the first panel relative to the portions of the same first fold lines of the second half-blank, and the second panel and third panel are themselves connected toward the outside to a fourth panel or to a bonding tab, by two other of said parallel fold lines, called second fold lines, the portions of second fold lines of the first half-blank being offset toward the inside of said second panel and third panel relative to the portions of the same second fold lines of the second half-blank;
- the offset between portions of one and the same first fold line is of one thickness or substantially of one thickness of cardboard and the offsets between portions of one and the same second fold line is of two thicknesses or substantially of two thicknesses of cardboard;
- two opposite panels each comprise a substantially central opening placed close to the transverse precut line, arranged in order to allow the separation by pressure or the pulling of one half-blank relative to the other after bonding of one to the other;
- the transverse precut line comprises a trapezium shaped portion making it possible to obtain a display case with inclined side walls.

The invention also proposes a case obtained with a blank as described above.

It also and more precisely proposes a packing case formed from material made of corrugated cardboard sheet, comprising two elements that can be separated manually from one another, namely a first element forming a display tray and a second element forming the upper portion of the case, the first and second elements being obtained from a single blank comprising a band comprising at least four main rectangular panels, connected together in pairs by parallel fold lines, and furnished with two series of flaps situated on either side, suitable for forming respectively at least partly the bottom and the top of the case, characterized in that the two elements are inserted in one another, in that the two elements are secured to one another by at least one blob of adhesive, and in that the band comprises a precut transverse line making it possible to divide the blank into two half-blanks in order to form said two elements, said transverse line determining on either side and for each parallel fold line two separate portions of fold line offset relative to one another in order to make it possible at least partly to compensate for the thicknesses of cardboard when wrapping the second half-blank over the first half-blank around a mandrel in order to form said case.

Advantageously, the transverse precut line comprises a trapezium-shaped portion making it possible to obtain a display case with inclined side walls.

Equally advantageously, two opposite panels each comprise a substantially central opening placed close to the transverse precut line, arranged in order to allow the separation by pressure of one element relative to the other after bonding of one to the other.

This pressure of one half-blank relative to the other, exerted perpendicularly to the walls, is weak and corresponds to a force of a few newtons, for example, less than in the order of 10, even 5 newtons, even 2 newtons or 1 newton.

On the other hand, the separation of the cover relative to the display tray in the direction parallel to the walls is difficult, the friction forces associated with the bonding of one to the other resisting well to the shearing stresses.

The invention also proposes a method for the production of a packing case with a polygonal section from a one-piece blank made of corrugated cardboard sheet, comprising a band comprising at least four main rectangular panels, connected together in pairs by parallel fold lines, and furnished with two series of flaps situated on either side, suitable for respectively forming at least partly the bottom and the top of the case, said band comprising a precut transverse line making it possible to divide the blank into two half-blanks, characterized in that after unstacking the blank, the user separates the two half-blanks, places the first half-blank in a transfer channel, the second half-blank being held in a plane higher than that of said transfer channel, the first half-blank is transferred to a mandrel While applying adhesive to it on the way, the first half-blank is wrapped around the mandrel, the transfer channel then being configured to allow the transfer of the second half-blank, said second half-blank is lowered to the channel, the second half-blank is transferred to the mandrel and is wrapped around the first half-blank itself wrapped around said mandrel, in order to form the side walls of the case, before refolding the flaps around said mandrel in order to form the bottom or the top portion of the case.

Advantageously, the separation of the half-blanks is carried out by shearing fingers.

Equally advantageously, the transfer of the half-blanks is obtained by pusher finger(s), the wrapping around the mandrel being carried out by flattening a panel of the band of the half-blank in question on the lower face of the mandrel, then wrapping and pressing the side panels by retractable devices on board the system for wrapping the panels.

The invention also proposes a device for forming a case from a single blank made of corrugated cardboard sheet, comprising a band comprising at least four main rectangular panels, connected together in pairs by parallel fold lines and furnished with two series of flaps situated on either side, suitable for forming respectively at least partly the bottom and the top of the case, said band comprising a precut transverse line making it possible to divide the blank into two half-blanks, characterized in that it comprises an assembly for unstacking the blank, a system for separating the half-blanks from one another, a channel for transferring the first half-blank to a mandrel, the second half-blank being held in a plane higher than that of said transfer channel, means for applying adhesive to the first half-blank during the transfer to a mandrel, means for wrapping the first half-blank around said mandrel, means for configuring the transfer channel in order to allow the transfer of the second half-blank to said mandrel, elevator means for lowering said second half-blank onto the channel, means for wrapping around the first half-blank itself wrapped around said mandrel, in order to form the band of the case, and means for flattening arranged in order to refold the flaps around said mandrel in order to form the bottom or the top portion of the case.

Means for ejecting the package thus formed are then also provided.

The present invention will be better understood on reading the following description of embodiments given as nonlimiting examples. The description refers to the drawings which accompany it, wherein:

FIGS. 5 to 11 show in perspective the steps for forming the package of FIG. 1 according to the embodiment of the invention more particularly described here.

Figure 1:
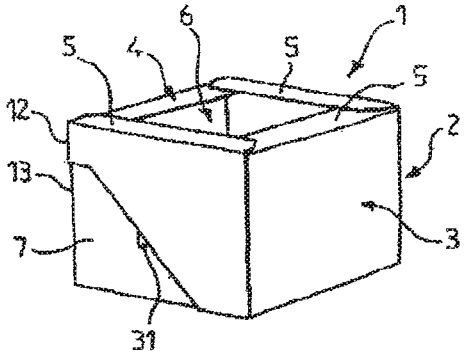
FIG. 1 is a view in Perspective of a Package according to a first embodiment of the invention.

FIG. 1 shows a parallelepipedal case 1 made of corrugated cardboard, for example 3 mm thick, comprising a band 2 comprising four rectangular walls 3.

The case consists of two elements, namely one element 4 forming the cover comprising flaps 5 constituting the punched top 6 of the case and a display tray 7 furnished with a bottom 8 advantageously consisting of one or more overlapping flaps 9 and having (see FIG. 2) a front side face 10 that is open and adjacent side faces 11 cut on a slant to better display the objects contained in the case (not shown). The cover fits into the display tray at least partly thanks to an offset between fold lines 12 and 13 respectively forming the edges of the tray and the cover, making it possible to flush-fit one into the other or the other into the one. FIG. 1 shows the cover capping the tray but it could very well be the other way round.

The one-piece blank making it possible to obtain the case of FIGS. 1 and 2 will now be described more precisely with reference to FIG. 3.

The blank 14 comprises the band 2 comprising four panels 15, 16, 17 and 18 suitable for forming the rectangular walls 3 and a substantially rectangular bonding end tab or lug 19.

The band 2 comprises a precut transverse line 20 separating the blank into two half-blanks 21 and 22 which are held together only by a few attachment points and which, as a result, can be torn apart from one another easily in the plane and/or perpendicularly to the plane of the blank.

Figure 2:
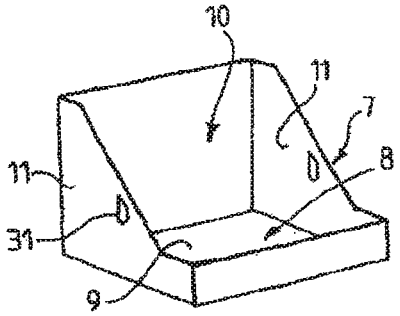
FIG. 2 is a view in perspective of the package of FIG. 1 after separation, showing the element forming the display case.
Figure 3:
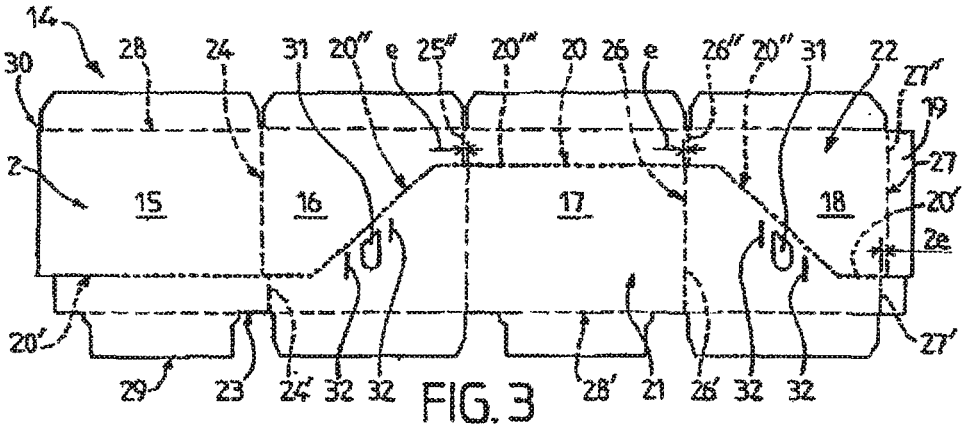
FIG. 3 is a plan view of the one-piece blank making it possible to obtain the package of FIG. 1.

In the embodiment of FIG. 3, the precut line 20 has a first portion 20' parallel to the bottom edge 23 of the end panel 15, which also extends over a first portion of the adjacent panel 16, then a second upward-sloping portion 20", over for example ⅔ of the panel, extended by a third portion 20'" again parallel to the bottom edge 23 of the panels over a second portion of the panel 16, over the whole of the central panel 17 and over a first portion of the last panel 18 to slope downward again at 20", in a manner symmetrical to the panel 16 and terminate parallel to the bottom edge on the last portion 20' of the panel 18 and over the bonding tab 19, so that the precut line has a portion in the shape of an isosceles trapezium making it possible to obtain the display case with inclined side walls 11 of FIG. 2.

According to the invention, each of the fold lines 24, 25, 26 and 27 being connected in pairs and respectively the panels 15, 16, 17, 18 and the tab 19 have two determined portions 24' and 24"; 25', 25"; 26', 26" and 27', 27" on either side of the transverse line 20, offset relative to one another in order to allow the compensation for the thicknesses of cardboard when the second half-blank is wrapped over the first half-blank around a mandrel or vice versa. More precisely, the one-piece blank 14 comprises the first central panel 17, connected on either side to the second panel 16 and to the third panel 18 by first parallel fold lines 25 and 26, the bottom portions 25' and 26' of the fold lines corresponding to the first half-blank 21 being offset toward the in side of said first panel relative to the portions 25" and 26" of the second half-blank 22, by a cardboard thickness, or slightly less than the latter.

The second and third panels 16 and 18 are themselves connected toward the outside to a fourth panel 16 on one side and to the bonding tab 19 on the other by first fold lines comprising for their part two bottom portions 24' and 27' corresponding to the first half-blank and offset toward the inside of the blank, that is to say respectively toward the second and third panels relative to the second portions 24" and 27" of the second half-blank 22 this time by two cardboard thicknesses or substantially by two thicknesses, in order to allow the second blank 22 to be wrapped over the first 21, as shown in FIG. 1.

The band of rectangular panels furthermore comprises on either side, connected by second fold lines 28, perpendicular to the first fold lines, two series of flaps, namely a first series of flaps 29 connected to the first half-blank 21 and a second series of flaps 30 connected to the second half-blank 22, said flaps being substantially rectangular and arranged to form at least partly the top and the bottom of the case.

The first half-blank 21 also comprises, on each of the two opposite panels 16 and 18, a substantially central opening 31 placed close to the transverse precut line 20 which will make it possible to separate the two half-blanks from one another by pressing or pulling one half-blank relative to the other, after the bonding of one to the other which is done at two bonding points and/or bonding lines 32 that are easy to separate, for example situated on either side of said opening, and initially placed facing one another on said first half-blank.

"Simply pressing" means a pressure of one cutout relative to the other with a force of a few newtons for example less than in the order of 10, even 5 newtons, that is sufficient to delaminate the cardboard and/or pull away the bond lines. More precisely, in order to separate the cover from the display case, the user places a finger in the opening and then clamps onto the other half-blank which he pulls outward.

Figure 4:
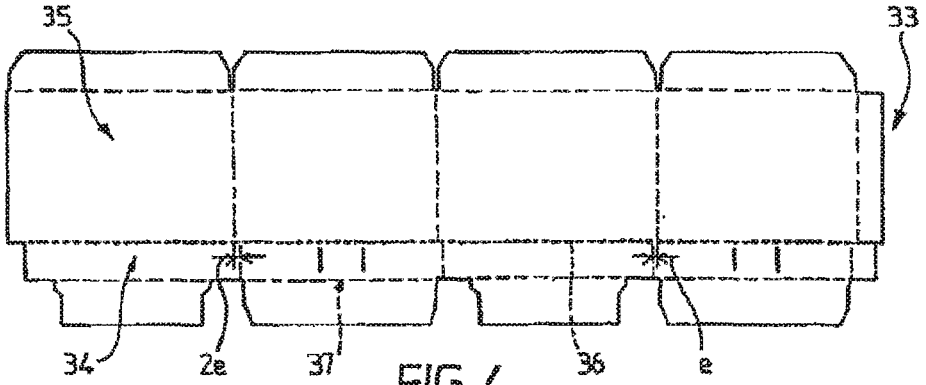
FIG. 4 is a plan view of a one-piece blank according to another embodiment of the invention.
Figure 5:
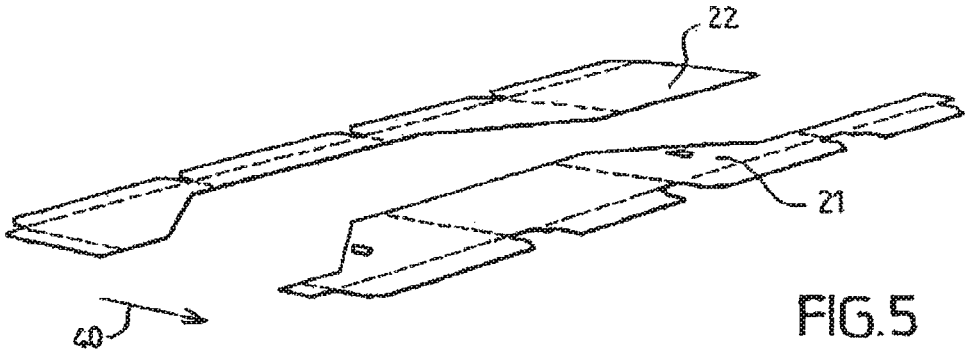
Figure 6:
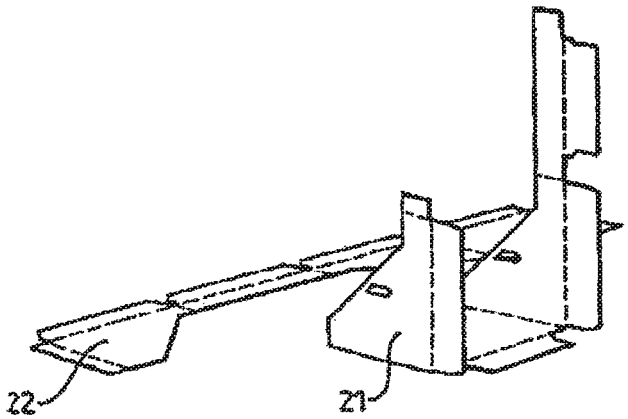
Figure 7:
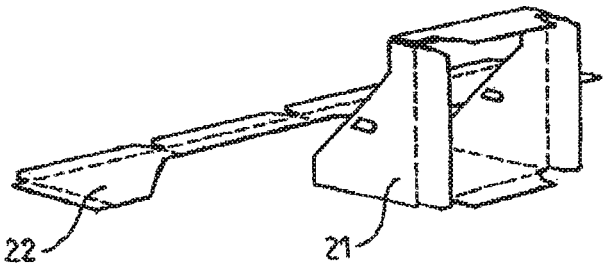
Figure 14:
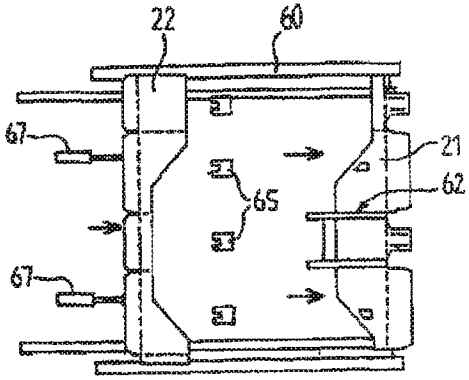
FIGS. 12, 14, 16 and 18 and FIGS. 13, 15, 17 and 19 show respectively in top view and in side view a device for forming the package according to the invention.
Figure 15:
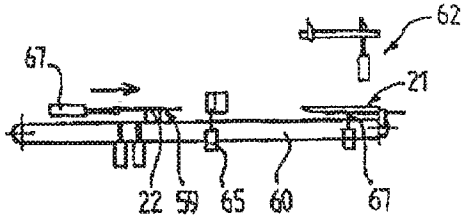
Figure 12:
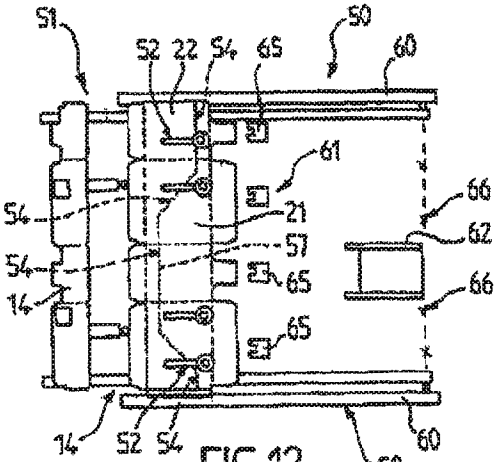
Figure 13:
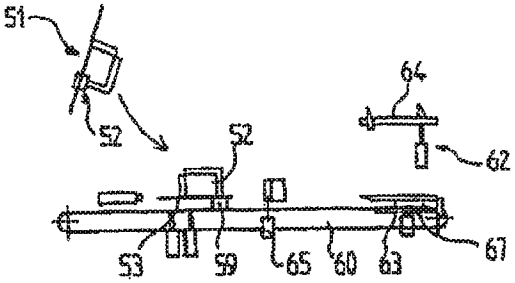
Figure 18:
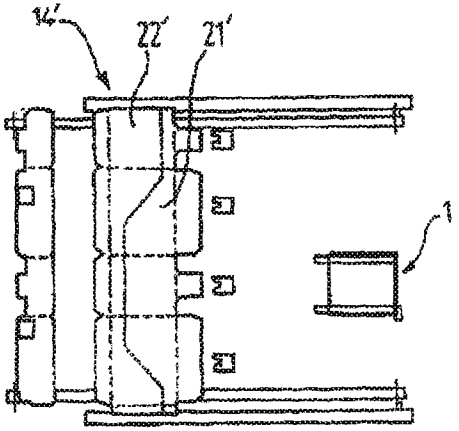
Figure 19:
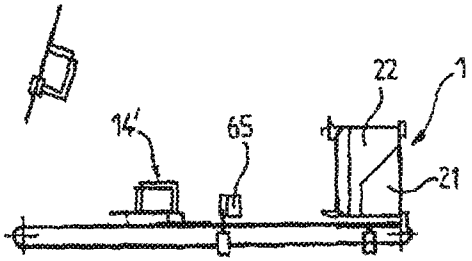
Figure 16:
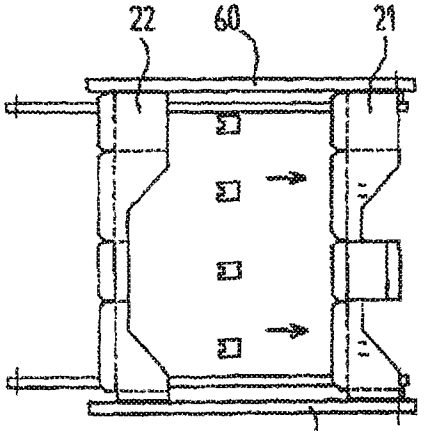

FIG. 4 shows another embodiment of a blank 33 according to the invention which comprises a first half-blank 34 connected to the second half-blank 35 by a transverse line 36 precut parallel to the second fold lines 37, so that the bottom tray has a parallelepipedal shape.

The first fold lines between the first half-blank and second half-blank are offset in exactly the same way as described with reference to FIG. 3.

The method for forming the case around a mandrel based on FIGS. 5 to 11 will now be described. After unstacking the blank, the two half-blanks 21 and 22 are separated from one another, for example by pulling sideways in the direction of the arrow 40 of the first half-blank relative to the second half-blank. The first half-blank 21 is wrapped (FIG. 6) around the mandrel (not shown) so as to form the bottom portion of the tray (see FIG. 7). Then the second half-blank is brought to face the end 41 of the first half-blank forming the tray, on the understanding that the first half-blank or the second half-blank has had adhesive applied to it beforehand at the bonding points, the latter, let it be remembered, then being capable of being easily separated by a user in order to separate the cover from the tray. The second half-blank is then wrapped (FIG. 9) around the end of the first half-blank in order to form (see FIG. 10) the package around the mandrel by refolding the last wall 15 of the second half-blank 22 and bonding to the facing tab 19.

Then the flaps 29 of the bottom of the tray are closed over the mandrel to form the bottom of the case. Finally, the package this formed is ejected, for example, by a cylinder situated inside the mandrel. The open case 1 may then, after being placed vertically, be filled from the top, before closure of the top flaps 30 and transport.

An embodiment of the device 50 will now be described using the method according to the embodiment of the invention most particularly described here, and represented schematically with reference to FIGS. 12 to 19 with the blank of FIG. 3.

The device 50 comprises an assembly 51 for supplying the cutouts or one-piece blanks 14 designed to form the cases.

This supply assembly 51 is known per se and makes it possible to pick up the blanks one by one using suction pads 52 and to then tip them onto a platform 53 on which the separation of the two half-blanks will be able to be carried out.

At the end of unstacking, the two half-blanks 21 and 22 are separated by four- or six-element fingers 54 indicated schematically (but not visible in FIG. 12 because they are situated beneath the blank) and positioned and distributed evenly in line with the precut line 57 constituted by the fastening points. These elements are for example formed by flat metal rods that can be retracted from beneath, comprising a possibility of sideways tearing movement in the direction of the mandrel, which will for its part be described below.

The first half-blank 21 is then placed in a transfer channel 58, the second half-blank remaining above the channel placed on an elevator 59.

The channel comprises two guide rails 60, adjustable in distance one relative to the other, in order to take account of the different widths of the half-blanks 21 and 22.

The first half-blank 21 is then transferred (see FIGS. 14 and 15) beneath the mandrel 62, furnished with bottom edges 63 and top edges 64 by said transfer means comprising for example two pickers (not shown) which pass beneath the second half-blank.

During the transfer, the bottom and the bonding lug have adhesive applied to them by adhesive-application means 15 known per se.

The first half-blank is then pushed up to the fixed transfer stops 66 and pressed under the mandrel by a movable plate or pusher plate 67.

The first half-blank 21 (see FIGS. 16 and 17) is then wrapped around the mandrel 62 by wrapping means, for example with a tipping arm, in a manner known per se, for example as described in patent EP 0334 707.

The accuracy of operation (correct positioning of the top panel) is ensured by a retractable positioner (not shown) on which the top panel presses during the folding of the bottom flaps and simultaneously pressurizes this same bottom and the bonding lug.

During the wrapping of the first half-blank 21, the transfer channel 58 moves away widthwise (see FIGS. 14 and 16) to adapt to the slightly larger dimension of the second half-blank 22, thanks to cylinders that are for example electric, in a manner within the scope of those skilled in the art.

Figure 17:
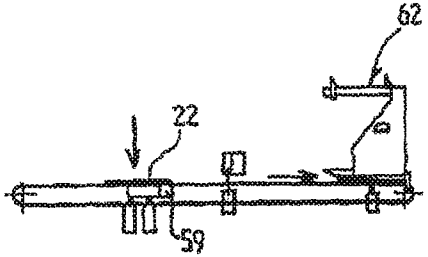

This second half-blank 22 is then pushed forward, by transfer pickers or cylinders 67 (see FIG. 15) and is then lowered via the elevator 59 into the channel (see FIG. 17).

It is also possible, for example, rather, to retract the pickers in order to dispense with the push that has just been mentioned.

The second half-blank is then transferred beneath the mandrel in the same way as the first half-blank by one or more pusher pickers.

During this second transfer, the two large panels are bonded for the purpose of subsequent assembly onto the first half-blank.

The bonding tab or lug also has adhesive applied to it. On arrival at the stop, the second half-blank 22 is pressed beneath the mandrel in contact with the first half-blank by the pusher plate which had moved aside again.

The second half-blank is, in turn, wrapped in the same manner as indicated heretofore.

A retractable positioner (not shown) acts on the corner of the case, pushing the top panel and the side panel adjacent to the bonding tab.

The side panels and the lug are then pressed by a retractable device on board the wrapping system (not shown) to allow the bonding and, for example simultaneously, the flattening of the flaps to form the bottom.

Finally, the case is ejected once completed by internal pushing on its bottom thanks to internal pushing means (in this instance again not shown), the case then falling in a vertical position to be filled. The connection of the side panels of the two half-blanks ensures the solidarity of the two half-blanks during this ejection.

During the wrapping of the second half-blank, the transfer channel is closed in order to return it to the dimensions of the first half-blank and the unstacking of the new one-piece blanks.

The cycle is then repeated with a new blank 14.

As it goes without saying and as also results from the foregoing, the present invention is not limited to the embodiments more particularly described. On the contrary, it covers all the variants thereof and notably those in which the tray portion is wrapped over the cover portion, and/or that in which both half-blanks remain in the same plane.

The invention claimed is:

1. A method for the production of a packing case with a polygonal section from a one-piece blank made of a corrugated cardboard sheet, the one-piece blank comprising a band, the band comprising a series of at least four main rectangular panels terminated by a fixing tongue to form side walls of the case, said series of at least four main rectangular panels and said fixing tongue being connected to one another by fold lines parallel to one another and the band being provided on one side with a first series of flaps connected to said series of at least four main rectangular panels for forming at least partly a bottom of the case, and being provided on an another side with a second series of flaps connected to said series of at least four main rectangular panels for forming a top of the case, the band comprising a pre-cut transverse line over the series of at least four main rectangular panels making it possible to divide the one-piece blank into a first half-blank and a second half-blank, wherein the method comprises the steps of:

unstacking the one-piece blank, separating said first half-blank from said second half-blank, placing the first half-blank in a transfer channel, while holding the second half-blank in a plane higher than that of the transfer channel, transferring the first half-blank to a mandrel and applying adhesive to the first half-blank during the transferring to the mandrel, wrapping the first half-blank around the mandrel, resulting in a wrapped first half-blank, lowering the second half-blank to the transfer channel, transferring, via the transfer channel, the second half-blank to the mandrel, and wrapping the second half-blank around the wrapped first half-blank to form the side walls of the case before folding the first and second series of flaps around the mandrel to form at least partly the bottom or the top of the case.

2. The method as claim in claim 1, wherein the separating of the half-blanks is carried out by shearing fingers.

3. The method as claimed in claim 1, wherein the mandrel has a lower face, wherein each of the first half-blank and the second half-blank has a first panel, wherein each first panel is connected to a first side panel on one side and, on the other side, said first panel is connected to a second side panel, wherein the second side panel is connected to a second panel, wherein the transferring of the first half-blank and the second half-blank is performed by pusher fingers, and wherein the wrapping of the first half-blank and the second half-blank is performed by a wrapping system, and wherein said method further comprises:

flattening said first panel of the first half-blank and said first panel of the second half-blank on the lower face of the mandrel, and wrapping and pressing the first and second side panels respectively of the first panel of said first half-blank and the first panel of said second half-blank by retractable devices of the wrapping system.

* * * * *